US008141625B2

(12) United States Patent
Reid

(10) Patent No.: US 8,141,625 B2
(45) Date of Patent: Mar. 27, 2012

(54) GAS BOOST CIRCULATION SYSTEM

(75) Inventor: Leslie C. Reid, Coweta, OK (US)

(73) Assignee: Baker Hughes Incorporated, Houston, TX (US)

( * ) Notice: Subject to any disclaimer, the term of this patent is extended or adjusted under 35 U.S.C. 154(b) by 408 days.

(21) Appl. No.: 12/486,561

(22) Filed: Jun. 17, 2009

(65) Prior Publication Data

US 2010/0319926 A1 Dec. 23, 2010

(51) Int. Cl.
*E21B 43/00* (2006.01)
*F04B 23/08* (2006.01)

(52) U.S. Cl. ..... 166/105.5; 166/68; 166/265; 417/423.3

(58) Field of Classification Search ..... 166/105.5, 166/68, 265; 417/423.5, 423.3
See application file for complete search history.

(56) References Cited

U.S. PATENT DOCUMENTS 4,676,308 A * 6/1987 Chow et al. ..... 166/369
6,550,535 B1 * 4/2003 Traylor ..... 166/265
6,668,925 B2 12/2003 Shaw et al.
6,676,366 B2 1/2004 Kao
6,691,782 B2 * 2/2004 Vandevier ..... 166/265
6,893,207 B2 5/2005 Kao
6,964,299 B2 * 11/2005 Scarsdale ..... 166/105
7,241,104 B2 7/2007 Wilson et al.
7,445,429 B2 11/2008 Wilson et al.
8,028,753 B2 * 10/2011 Shaw et al. ..... 166/369
2009/0032264 A1 2/2009 Shepler
2009/0065202 A1 3/2009 Brown et al.

* cited by examiner

*Primary Examiner* — Kenneth L Thompson
(74) *Attorney, Agent, or Firm* — Bracewell & Giuliani LLP

(57) ABSTRACT

A submersible well pump assembly in a wellbore; the pump assembly includes a liquid lift pump and a booster pump for pumping a two-phase mixture of gas and liquid. A shroud with an opening at its upper end partially encloses the pump assembly. An annulus is formed between the shroud and the wellbore inner circumference. Two phase fluid from the booster pump exits the shroud through a port and flows up the annulus to the shroud opening. Liquid in the two-phase flow separates from the gas and flows into the shroud opening and onto the liquid lift pump. The gas continues to flow up the wellbore, past the shroud opening, to the wellbore entrance.

20 Claims, 4 Drawing Sheets

GAS BOOST CIRCULATION SYSTEM

BACKGROUND

1. Field of Invention

The present disclosure relates in general to electrical submersible well pumps. More particularly, the present disclosure is directed to a submersible pump assembly that includes a liquid lift pump and a two phase fluid booster pump disposed in an inverted shroud. Two phase fluid is propelled from the booster pump to the shroud entrance where liquid separates and flows to the liquid lift pump.

2. Description of Prior Art

An electrical submersible pump assembly (ESP) for a well typically includes a centrifugal pump driven by a submersible electrical motor. The ESP is normally installed within the well on tubing. Many wells produce a combination of oil and water as well as some gas. Centrifugal pumps are mainly designed to handle liquid and will suffer from head degradation and gas locking in the presence of a high percentage of free gas. Several techniques have been developed to remove the gas before it enters the pump.

One technique relies on causing the well fluid to flow downward before reaching the pump intake thereby allowing gravity separation of gas. Gas bubbles within the well fluid flow tend continue flowing upward as a result of gas bubble buoyancy and gravity acting on the liquid. The downward flowing liquid in the well fluid creates an opposing drag force that acts against the upward moving bubbles. If the upward buoyant force is greater than the downward drag force, the bubbles will break free of the downward flowing well fluid and continue moving upward. Buoyancy is a function of the volume of the bubble, and the drag force is a function of the area of the bubble. As the diameter of the bubble increases, the buoyant force will become larger than the drag force, enabling the bubble to more easily separate from the liquid and flow upward. Consequently, if the bubbles can coalesce into larger bubbles, rather than dispersing into smaller bubbles, the separating efficiency would be greater.

A shroud may be mounted around the portions of the ESP to cause a downward flow of well fluid. In one arrangement, the upper end of the shroud is sealed to the ESP above the intake of the pump, and the lower end of the shroud is open. The perforations in the casing are located above the open lower end of the shroud in this arrangement. The well fluid will flow downward from the perforations past the shroud and change directions to flow back up into the shroud, around the motor and into the pump intake. Some gas separation may occur as the well fluid exits the perforations and begins flowing downward.

In an inverted type of shroud, the shroud is sealed to the ESP below the pump intake and above the motor, which extends below the shroud. The inlet of the shroud is at the upper end of the shroud above the pump. The perforations in the casing are below the motor, causing well fluid to flow upward past the motor and shroud and back downward into the open upper end of the shroud. Passive gas separation occurs as the well fluid changes direction to flow downward into the shroud.

Another technique employs a gas separator mounted in the submersible pump assembly between the motor seal section and the pump entrance. The gas separator has an intake for pulling fluids in and a rotating vane component that centrifugally separates the gas from the liquid. The liquid is then directed to the entrance of the pump, and the gas is expelled back into the annulus of the casing. The gas separator provides a well fluid to the pump with a gas content low enough so that it does not degrade the pump performance. The quality of the fluid discharged back into the casing is normally of little concern. In fact, it may have a roughly high liquid content, but the liquid will return back downward to the gas separator intake while the gas would tend to migrate upward in the casing.

Normally, a gas separator would not be incorporated with a shrouded ESP because of the problem of disposing of the gas into the well fluid flowing toward the inlet of the shroud. Gas being discharged into flowing well fluid tends to break up into smaller bubbles and become entrained in the flow. If the shroud inlet is on the lower end, any gas discharged from the gas separator into the shroud annulus would be entrained in the downward flowing fluid and re-enter the inlet. If the shroud inlet is on the upper end, any gas discharged from the gas separator would flow upward through the annulus surrounding the shroud and might fail to separate from the liquid at the inlet of the shroud where the well fluid begins flowing downward.

SUMMARY OF INVENTION

Disclosed herein is a system and method for producing wellbore fluids, in an example, the system is a submersible pumping system disposed in a wellbore having an elongated annular shroud with an upper end and a lower end, an annulus formed between the shroud and the well bore inner circumference, a multi-phase fluid booster pump having an inlet in fluid communication with fluid in the wellbore below the lower end of the shroud and a discharge in fluid communication with the annulus, so that multi-phase fluid discharged from the booster pump flows up the annulus to an inlet at or near the shroud and so that liquid in the multi-phase fluid separates out and flows into the shroud upper end as separated liquid, a liquid lift pump having an inlet within the shroud in fluid communication with the separated liquid and a discharge, and production tubing extending from the liquid lift pump discharge through the shroud entrance. The booster pump can be disposed within the shroud below the liquid lift pump, where a barrier separates the booster pump discharge from the liquid lift pump inlet. Alternatively, the booster pump can be within the shroud and a barrier is included between the shroud and the wellbore in the annulus. The shroud can include an outlet for the booster pump discharge above the barrier in the annulus. An exit port can be formed through the extension between the booster pump and the closed end. In an example, the system booster pump inlet and discharge are within the shroud and the closed end comprises a seal. A barrier can be included in the annulus between the discharge and the booster pump inlet. The booster pump can include a motive device selected from the list consisting of a rotatable auger for moving a multi-phase mixture, a high angle vane auger, a multi vane impeller, a progressive cavity type pump a conventional ESP pump, a jet pump, or combinations thereof. The system can further include a submersible motor connected to and driving both the liquid lift pump and the booster pump, wherein the motor is between the liquid lift pump and the booster pump. The shroud inlet can be at least one aperture in its sidewall above the liquid lift pump.

Also included herein is a method of producing a multi-phase fluid from a wellbore. In an example the method includes deploying a shroud in the wellbore that encloses an inlet of a liquid lift pump therein, the shroud having an inlet at or near its upper end, with a booster pump, conveying a multi-phase fluid of the well up around at least a part of the shroud to the shroud inlet, so that liquid is gravity separated from the multi-phase fluid and flows downward within the shroud to the liquid lift pump inlet, and pumping the liquid with the liquid lift pump through production tubing to the wellbore surface.

A wellbore production system is disclosed herein having a motor, a liquid lift pump coupled to the motor, production tubing attached to a liquid lift pump discharge, and a shroud enclosing the motor and an inlet of the liquid lift pump. The wellbore production system further includes a booster pump below the liquid lift pump and driven by the motor, the booster pump having a discharge and an inlet separated by a barrier in the wellbore for conveying wellbore fluid up an annulus surrounding the shroud and into an inlet of the shroud located above the inlet of the liquid lift pump, so that gas separates from the wellbore fluid as it turns to flow downward in the shroud.

BRIEF DESCRIPTION OF DRAWINGS

Some of the features and benefits of the present invention having been stated, others will become apparent as the description proceeds when taken in conjunction with the accompanying drawings, in which.

Figure 1:
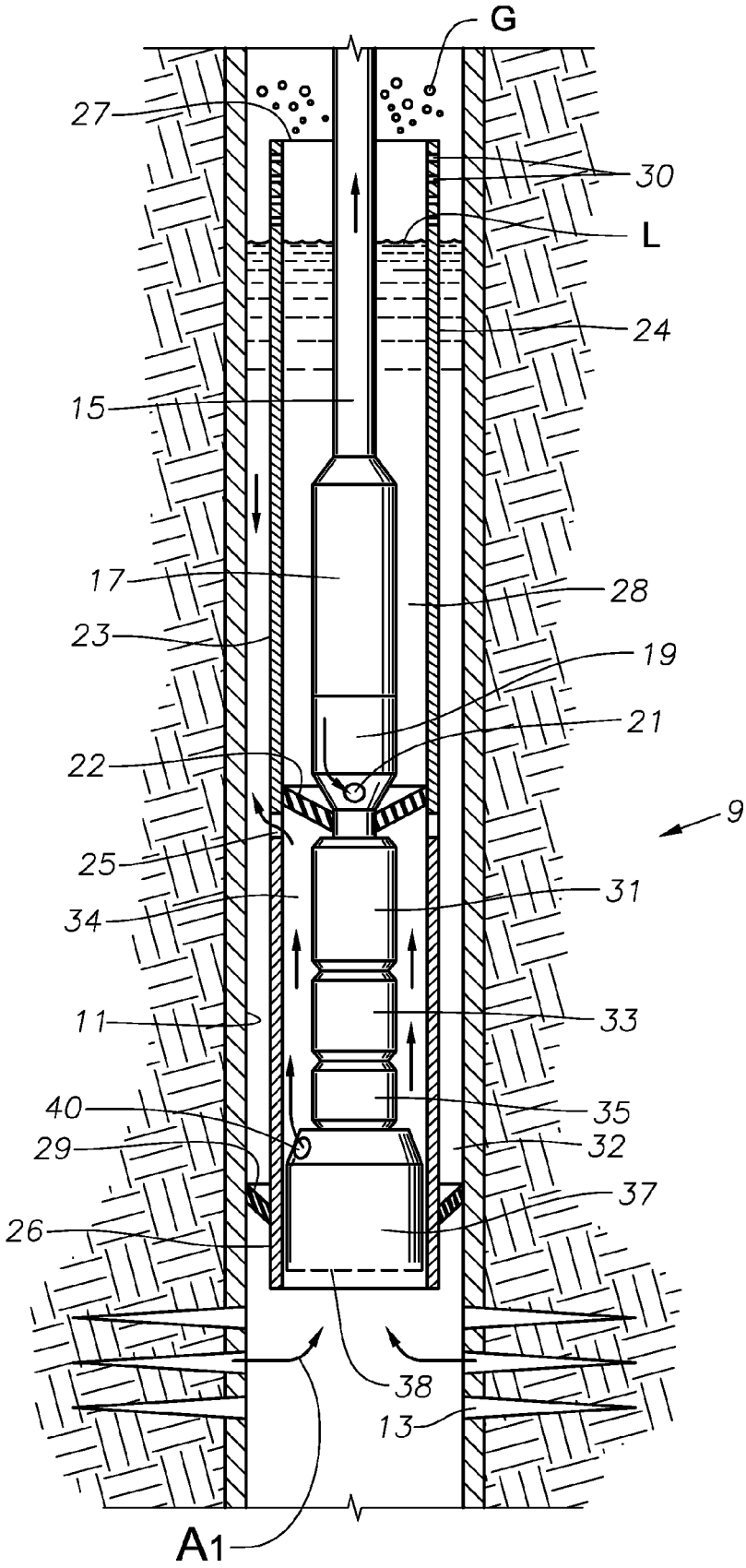
FIG. 1 is a partial sectional view of an embodiment of an apparatus for producing fluid from a wellbore in accordance with the present disclosure.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DESCRIPTION OF THE INVENTION

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

Referring to FIG. 1, cased borehole 11 illustrates a typical well having an inlet comprising perforations 13 for the flow of well fluid containing gas and liquid into cased borehole 11. A pumping system 9 is provided in the well and shown coaxially disposed within a shroud 23, which may also be referred to as a jacket or liner. A string of tubing 15 extends downward from the surface for supporting a rotary pump 17. Pump 17 is illustrated as being a centrifugal pump, which is one having a large number of stages, each stage having an impeller and a diffuser. Pump 17 could be other types of rotary pumps, such as a progressing cavity pump. Optionally, a second pump 19 is illustrated to form a tandem pump assembly. An inlet 21 for liquid flow to impellers (not shown) within the pumps 17, 19 is shown at the base of the pump 19. A flow barrier, shown as a sealing gland 22, circumscribes the pump 19 adjacent the inlet 21 and radially projecting outward to the shroud 23 inner surface. The sealing gland 22 pressure isolates portions of the pumping assembly 9 on opposing sides of the sealing gland 22. A seal section 31 secures to the lower end of pumps 17, 19. A motor 33, normally an electrical three-phase motor, secures to the lower end of seal section 31. Seal section 31 has means within it for equalizing the pressure of the lubricant contained in motor 33 with the well fluid on the exterior of motor 33.

For reference purposes, the shroud 23 includes upper and lower portions 24, 26 shown projecting from the sealing gland 22 in opposite directions. An upper inner annulus 28 is defined between the pumping system 9 and the upper portion 24 and a lower inner annulus is defined between the pumping system 9 and the lower portion 26. A booster pump 37 is schematically illustrated in the lower portion 26 below the motor 33 and mechanically coupled to the motor 33 by a thrust coupling 35 having a thrust bearing. The thrust coupling could also contain a gear box so the booster pump 37 can operate at a 'higher or lower' rotational speed than the motor 33. Advantages are gas boosting is enhanced at higher rotational speeds, and the lower rpm PCPs could be implemented without other modifications. The booster pump 37 receives mechanical energy from the motor 33 to drive rotary elements (not shown) for pumping a fluid. When in operation, reactive forces from the fluid onto the rotary elements translate into an axial force that is absorbed by the thrust coupling 35. Without the coupling 35, the axial forces can damage the motor 33. A shaft seal (not shown) may be included with the thrust coupling 35 to protect the motor 33, this assembly could also contain a self pressure equalization feature or use the equalization provided by the top seal section 31.

The fluid to be pumped by the booster pump 37 is illustrated by arrows $A_1$ representing fluid flow from the perforations 13 towards inlets 38 provided on the booster pump 37. The fluid may be a multi-phase flow that includes gas, liquid, and fluids in a critical state, that is fluids at or above either their critical pressure or critical temperature. The multi-phase fluid can contain at least two of the gas, liquid, or critical fluid. Fluid from the perforations 13 is directed to the booster pump 37 by a flow barrier, shown as a sealing gland 29, that blocks an outer annulus 32 between the shroud 23 and wellbore 11. Although the booster pump 37 couples with the thrust section 35, fluid exits the booster pump 37 from a booster pump exit 40 and flows in a lower inner annulus 34 within lower portion 26 that circumscribes the motor 33 and seal section 31. Fluid exiting the lower inner annulus 34 flows out ports in shroud 23 into the annulus 32 below lower port in the seal gland 22 then up within the wellbore 11 towards the shroud opening 27.

Perforations 30 are shown formed laterally through the shroud 23 near its upper end, providing fluid communication between the lower inner annulus 34 and upper inner annulus 28. At this point, gravity separates liquid from the multi-phase fluid so that the liquid can flow through the perforations 30 and within the shroud 23 allowing the gas G within the multi-phase fluid to continue its path upward within the wellbore 11. A liquid level L is shown proximate the region on the shroud 23 having the perforations 30. Forming a liquid column within the shroud 23 increases static pressure of the liquid as it flows into the pump 19 through the inlet 21, thereby adding extra margins to prevent gas lock or cavitation within either of the pumps 17, 19. Thus, in an embodiment, the distance between the fluid inlet 21 and perforations 30 and/or shroud inlet 27 is set so that fluid pressure at the inlet 21 is maintained above a pre-determined value. Setting this distance is within the capabilities of those skilled in the art.

Figure 2:
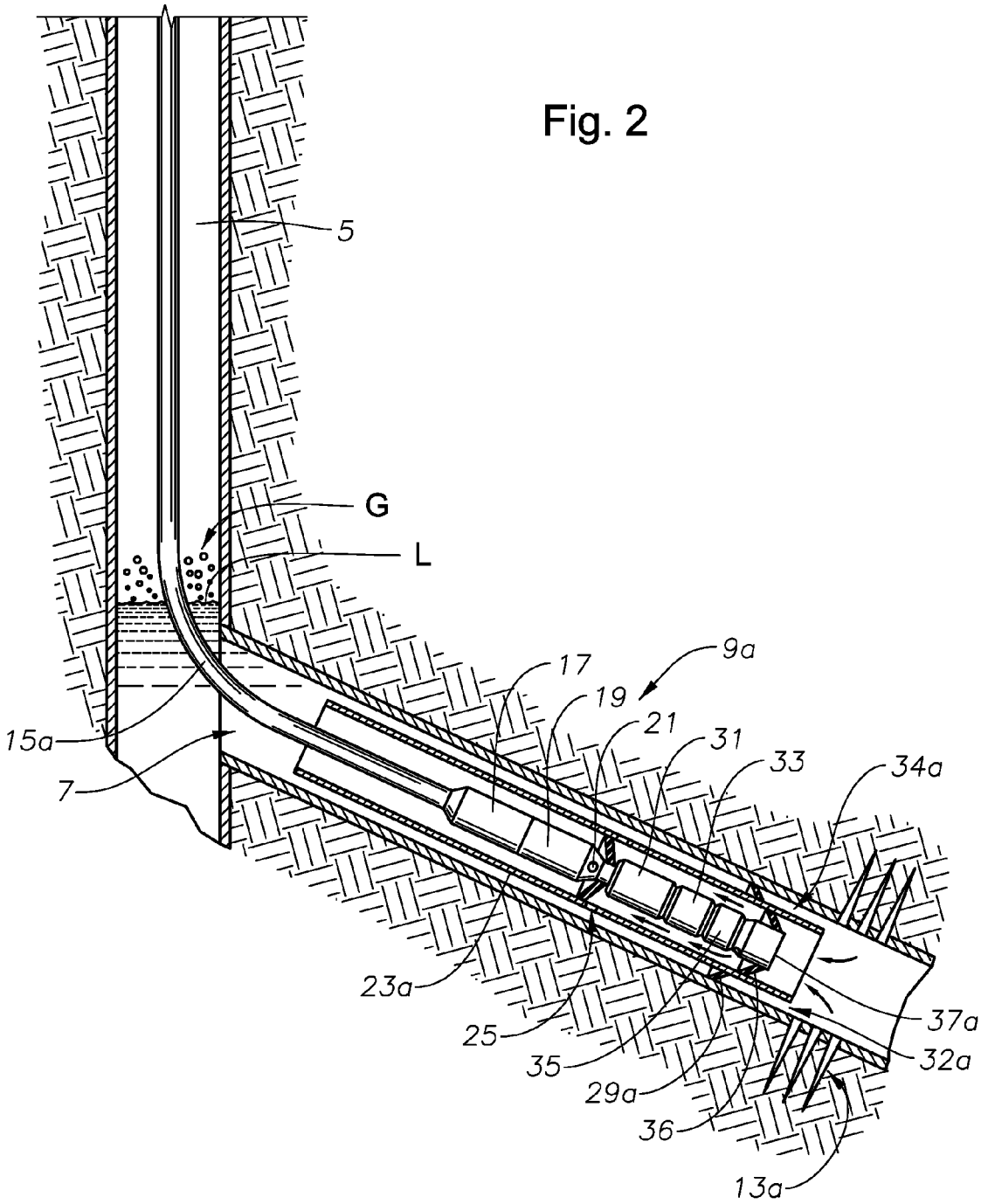
FIG. 2 schematically depicts the fluid producing apparatus of FIG. 1 in a horizontal portion of a wellbore.

FIG. 2 provides a partial sectional view of an alternative pumping system 9*a* disposed in a slanted wellbore 7 shown laterally depending from a vertical wellbore 5. A liquid level L is shown formed in the opening of the slanted wellbore 7. Differences between the pumping system 9*a* of FIG. 2 and pumping system 9 of FIG. 1 include bent production tubing 15*a* at the angled intersection of the vertical and slanted wellbores 5, 7, and a reduced diameter booster pump 37*a*. An optional sealing gland 36 circumscribes the booster pump 37*a* forming a seal in the lower inner annulus 34*a* and a seal 29*a* is shown in an outer annulus 32*a* disposed between the shroud 23*a* and slanted wellbore 7. In this embodiment, fluid flows into the slanted wellbore 7 from perforations 13*a* and is directed to the booster pump 37*a* inlet by the seal 29*a*. Pressurized fluid, which can include multi-phase fluid, exits the booster pump 37*a* into the lower inner annulus 34*a* before exiting the shroud 23*a* through port 25*a*. Liquid in the pressurized fluid can separate at the liquid level L shown at the vertical and slanted wellbore 5, 7 intersection. Similarly, gas G in the fluid can then flow upward within the wellbore 5.

Figure 3:
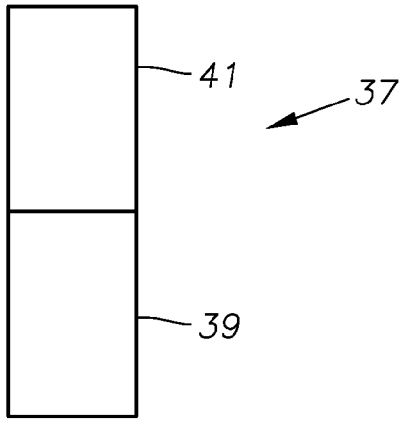
FIG. 3 is a side schematic depiction of a portion of the apparatus of FIG. 1.
Figure 3:
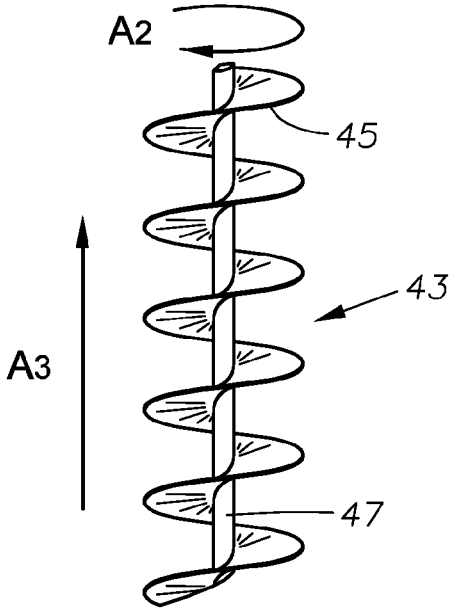

FIG. 3 schematically depicts an example of a booster pump 37 that includes an upstream conveyor/elevator section 39 and a downstream pressurizing section 41. This embodiment combines different methods of displacing fluid. A conveyor elevator section 39, which can displace more volume per time than a pressurizing device, employs an auger or screw-like mechanism that vertically urges the fluid upward. The conveyer elevator section 39 is operable on multi-phase fluids. The pressurizing section 41 increases fluid pressure and also is able to operate on a multi-phase fluid.

Figure 4:
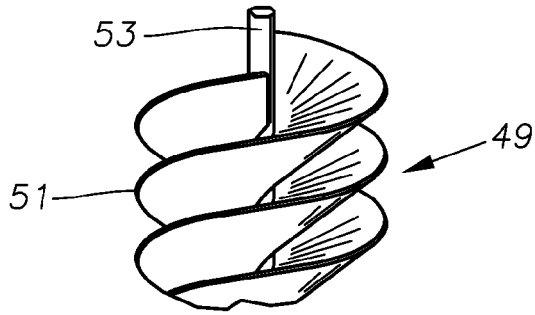
FIG. 4 portrays in a perspective view examples of devices for use in the portion of FIG. 3.

Examples of a conveyor elevator section 39 are depicted in side perspective view in FIG. 4. An auger 43 is shown that includes a helical fin or vane 45 that winds along an elongated shaft 47. Rotating the shaft 47 as shown by direction of the arrow $A_2$ conveys a multi-phase fluid along the shaft 47 in direction of arrow $A_3$. Also shown in FIG. 4 is a high angle vane auger 49 also having a vane 51 helically arranged around a shaft 53 but at a more acute angle to the shaft 53 than the auger 43. Rotating the high angle vane auger 49 also motivates the multi-phase fluid.

Figure 5:
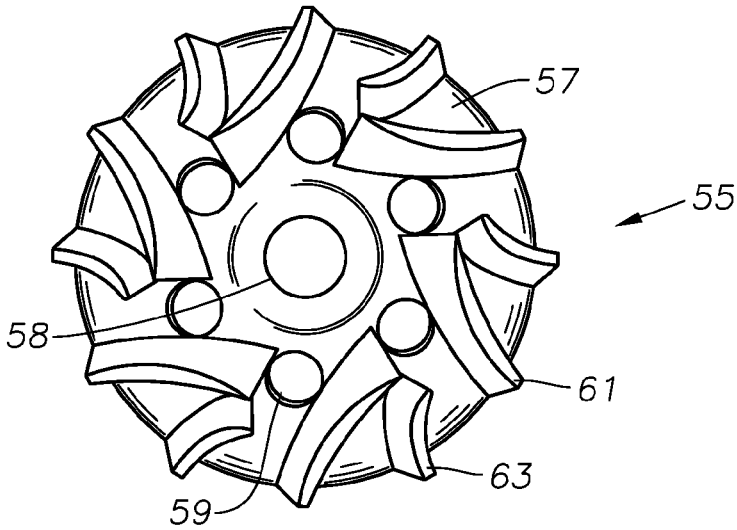
FIG. 5 illustrates in an overhead view an example of a device for use in the portion of FIG. 3.

Depicted in overhead view in FIG. 5 is an example of an impeller 55 that includes a disk like shroud 57. Formed through the shroud 57 center is a vertically oriented opening 58. Circular passages 59 also formed through the shroud 57 in a circular pattern around the opening 58. The passages 59 provide a flow path through the shroud 57 for vapor or gas. Unlike traditional impellers that include a single size vane on its surface; the impeller 55 includes a series of elongated vanes 61 combined with a series of shorter truncated vanes 63. Moreover, the angles of the vanes 61, 63 vary with respect to one another. An example of a multi-vane impeller is shown in Kao, U.S. Pat. No. 6,893,207; that is assigned to the assignee of the present application and incorporated by reference herein in its entirety. It should be pointed out that the booster pump 37 can employ one of either the conveyor elevator section 39 or a pressurizing section 41 in addition to the combination of these different configurations.

Figure 6:
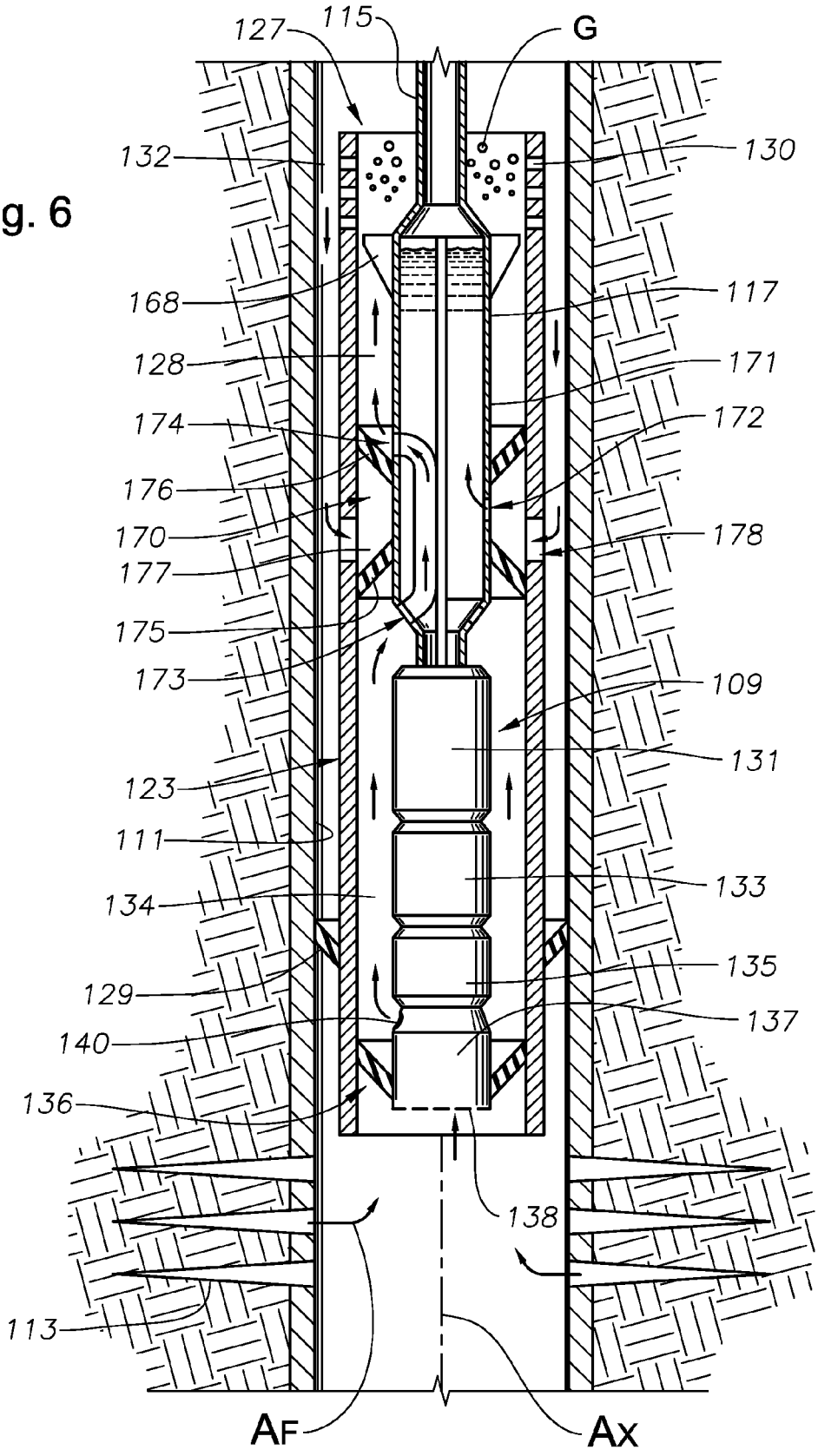
FIG. 6 is a partial sectional view of an alternative embodiment of an apparatus for producing fluid from a wellbore in accordance with the present disclosure.

Shown in side partial sectional view in FIG. 6 is an example of a pumping assembly 109 coaxially inserted within a shroud 123 and both deployed in a cased wellbore 111. Shown in a stacked arrangement, the pumping assembly 109 components include a booster pump 137, a thrust section 135, a motor 133, a seal section 131, a cross over section 170, and a liquid pump 117. The components 109, 137 135, 133, 131, and 117 can be substantially similar to or the same as the pumping assembly 9 components described above. Fluid, represented by arrows AF, flows from perforations 113 projecting outward from the wellbore 111 into the surrounding formation. Fluid exiting the perforations 113 is directed to the booster pump inlet 138 by seals 129, 132. Seal 129 seals the annulus 132 between the pumping assembly 109 and wellbore 111 inner wall and seal 136 seals between the booster pump 137 and shroud 123. Thus fluid flowing from the perforations 113 is forced towards the booster pump 137 and cannot flow around it. The fluid, which as described above can be a multi-phase fluid, is discharged through a pump exit 140 from the booster pump 137 into a lower inner annulus 134 defined by the space between the pumping assembly 109 and shroud 123. The discharged fluid is shown flowing upward in the annulus 134 and past the thrust section 135, motor 133, and seal section 131.

The lower inner annulus 134 extends upward to a lower cross over seal 175 shown attached to the shroud 123 inner surface and extending to the body 171 of the cross over section 170. An upper cross over seal 176 is provided above the lower cross over seal 175, and also extends between the cross over body 172 and shroud 123 inner surface. A cross over annulus 177 is defined between the upper and lower cross over seals 176, 175 and an upper inner annulus 128 is defined in the annular space above the upper cross over seal 176. The flowing fluid that reaches the annulus 134 upper end is diverted from the lower inner annulus 134 by the lower cross over seal 175 into a cross over inlet 173 formed in the cross over body 172. The fluid flows from the cross over body 172 through a cross over outlet 174 where it is discharged into the upper inner annulus 128. Directed upward by the upper cross over seal 176, the fluid flows upward away from the cross over annulus 177 and towards the shroud open end 127.

Before reaching the shroud open end 127, the fluid encounters vanes 168 that project radially outward from the pump 117 outer housing. The vanes 168 are an example of an obstacle in the fluid flow path for creating fluid pertubations that promote separation of different phases that may be present in the fluid. The vanes 168 are depicted as largely planar triangularly shaped members oriented lengthwise substantially parallel with the pumping assembly axis $A_X$. Other embodiments exist for the vanes 168, such as members helically arranged on either the pump 117 housing, shroud 123 inner surface, or both. These types of members promote a circulation of the fluid (similar to a vortex) forcing the heavy fluid (liquid) to the outermost portion of the annulus separating it from the lighter fluid (gas) which would remain near the center. In FIG. 6, a series of perforations 130 through the shroud 123 near its top end. These perforations 130 will allow the heavy fluid liquid (which is circulating outward) to flow into the annulus 132. This enhancement could greatly improve gas separation ability of the system, thus allowing for shorter shrouds. Additionally, the vanes 168 may have a shape that is non-triangular, including those having curved profiles.

At the shroud open end 127, shown in FIG. 6 to be above the pump 117, phases in the liquid can be separated from one another. Gas G continues its upward path in the wellbore 111 whereas liquid in the fluid travels radially outward and over the shroud 123 top, or through the perforations 130 as described above. Once outside of the shroud 123, the liquid changes direction beginning a downward descent into the annulus 132. The seals 129 provide a lower fluid containment allowing a liquid level in the annulus 132. Inlets 178 are shown provided through the shroud 123 adjacent the cross over annulus 177. Liquid in the annulus 132 flows through the inlets 178, into the cross over annulus 177, where it is directed to a pump inlet 172 in the cross over body 171. A conduit path in the cross over body 171 delivers the liquid to the pump 117 where it can be pressurized and discharged to the tubing attached to the pump 117 discharge.

While the invention has been shown in only two of its forms, it should be apparent to those skilled in the art that it is not so limited but it is susceptible to various changes without departing from the scope of the invention. For example, an alternative to the booster pump 37 can include any method for conveying two-phase and/or multi-phase fluid upward from within a wellbore. Some specific examples include a progressive cavity type pump a conventional ESP pump, a jet pump, or combinations thereof. Example alternative methods can be found in Wilson et al., U.S. Pat. No. 7,444,429, Wilson et al., U.S. Pat. No. 7,241,104, and Shaw et al., U.S. Pat. No. 6,668,925; each of which are assigned to the assignee of the present application and incorporated by reference herein in their entireties.

What is claimed is:

1. A submersible pumping system disposed in a well bore comprising:

an elongated annular shroud having an upper end and a lower end;

an annulus formed between the shroud and the well bore inner circumference;

a multi-phase fluid booster pump having an inlet in fluid communication with fluid in the wellbore below the lower end of the shroud and a discharge in fluid communication with the annulus, so that multi-phase fluid discharged from the booster pump flows up the annulus to an inlet at or near the shroud and so that liquid in the multi-phase fluid separates out and flows into the shroud upper end as separated liquid;

a liquid lift pump having an inlet within the shroud in fluid communication with the separated liquid and a discharge; and production tubing extending from the liquid lift pump discharge through the shroud entrance.

2. The system of claim 1 wherein the booster pump is disposed within the shroud below the liquid lift pump and a barrier separates the booster pump discharge from the liquid lift pump inlet.

3. The system of claim 2, wherein the booster pump is within the shroud and the system further comprises a barrier between the shroud and the wellbore in the annulus; and an outlet in the shroud for the booster pump discharge above the barrier in the annulus.

4. The system of claim 2, further comprising an exit port through the extension between the booster pump and the closed end.

5. The system of claim 1, wherein the booster pump inlet and discharge are within the shroud and the closed end comprises a seal.

6. The system of claim 1, further comprising a barrier in the annulus between the discharge and the booster pump inlet.

7. The system of claim 1, wherein the booster pump comprises a motive device selected from the list consisting of a rotatable auger for moving a multi-phase mixture, a high angle vane auger, a multi vane impeller, a progressive cavity type pump a conventional ESP pump, a jet pump, and combinations thereof.

8. The system of claim 1, further comprising a submersible motor connected to and driving both the liquid lift pump and the booster pump, wherein the motor is between the liquid lift pump and the booster pump.

9. The system of claim 1, wherein the shroud inlet comprises at least one aperture in its sidewall above the liquid lift pump.

10. A method of producing a multi-phase fluid from a wellbore comprising:

deploying a shroud in the wellbore that encloses an inlet of a liquid lift pump therein, the shroud having an inlet at or near its upper end;

with a booster pump, conveying a multi-phase fluid of the well up around at least a part of the shroud to the shroud inlet, so that liquid is gravity separated from the multi-phase fluid and flows downward within the shroud to the liquid lift pump inlet; and pumping the liquid with the liquid lift pump through production tubing to the wellbore surface.

11. The method of claim 10, wherein the multi-phase fluid is conveyed by the booster pump from below the liquid lift pump.

12. The method of claim 10, further comprising driving the booster pump and the liquid lift pump with the same motor.

13. The method of claim 12, further comprising:

positioning a discharge of the booster pump in the shroud below the liquid lift pump inlet;

sealing between the booster pump discharge and liquid lift pump inlet; and providing an outlet through the shroud for the booster pump discharge into an annulus surrounding the shroud.

14. The method of claim 10, further comprising setting the distance between the liquid lift pump inlet and shroud inlet so that a minimum liquid level in the shroud above the liquid lift pump inlet is maintained.

15. In a wellbore production system having a motor, a liquid lift pump coupled to the motor, production tubing attached to a liquid lift pump discharge, and a shroud enclosing the motor and an inlet of the liquid lift pump, the improvement comprising:

a booster pump below the liquid lift pump and driven by the motor, the booster pump having a discharge and an inlet separated by a barrier in the wellbore for conveying wellbore fluid up an annulus adjacent the shroud and into an inlet of the shroud located above the inlet of the liquid lift pump, so that gas separates from the wellbore fluid as it turns to flow downward on an opposite side of the shroud.

16. The wellbore production system of claim 15, wherein the booster pump discharge is in the shroud and the annulus surrounds the shroud, the wellbore further comprising a port formed through the shroud and a barrier in the shroud between the booster pump discharge and liquid lift pump, wherein the fluid flows through the port and up the annulus.

17. The wellbore production system of claim 16, wherein the barrier comprises a seal in the annulus between the shroud and the wellbore inner surface and below the port.

18. The wellbore production system of claim 15, wherein the booster pump inlet is located within the shroud.

19. The wellbore production system of claim 15, wherein the booster pump comprises a motive device selected from the list consisting of a rotatable auger for moving a multi-phase mixture, a high angle vane auger, a multi vane impeller, a progressive cavity type pump a conventional ESP pump, a jet pump, and combinations thereof.

20. The wellbore production system of claim 15, wherein the motor is located between the booster pump and the liquid lift pump.

* * * * *